US008376076B2

(12) United States Patent
Kataoka et al.

(10) Patent No.: US 8,376,076 B2
(45) Date of Patent: Feb. 19, 2013

(54) DEVICE STORAGE APPARATUS FOR RAILWAY VEHICLE

(75) Inventors: Shin Kataoka, Kobe (JP); Kunihiko Takagi, Akashi (JP); Yutaka Kitagawa, Kobe (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 71 days.

(21) Appl. No.: 13/025,716

(22) Filed: Feb. 11, 2011

(65) Prior Publication Data

US 2011/0234070 A1 Sep. 29, 2011

(30) Foreign Application Priority Data

Feb. 18, 2010 (JP) ..... 2010-033312

(51) Int. Cl.
*B60R 16/04* (2006.01)

(52) U.S. Cl. ..... 180/68.5; 104/34; 105/51

(58) Field of Classification Search ..... 180/65.1, 180/68.5; 104/34; 105/51
See application file for complete search history.

(56) References Cited

U.S. PATENT DOCUMENTS

| | | | | |
|---|---|---|---|---|
| 3,930,552 | A * | 1/1976 | Kunkle et al. | 180/68.5 |
| 4,216,839 | A * | 8/1980 | Gould et al. | 180/65.1 |
| 4,480,710 | A * | 11/1984 | Hansen | 180/68.5 |
| 4,609,313 | A | 9/1986 | Oshino et al. | |
| 6,631,775 | B1 * | 10/2003 | Chaney | 180/68.5 |
| 6,938,553 | B2 | 9/2005 | Tamaki et al. | |
| 7,201,384 | B2 * | 4/2007 | Chaney | 180/68.5 |
| 7,712,563 | B2 * | 5/2010 | Niebuhr | 180/68.5 |

FOREIGN PATENT DOCUMENTS

| | | |
|---|---|---|
| JP | U-60-27024 | 2/1985 |
| JP | U-60-27025 | 2/1985 |
| JP | U-60-150772 | 10/1985 |
| JP | A-2009-241765 | 10/2009 |

* cited by examiner

*Primary Examiner* — J. Allen Shriver, II
*Assistant Examiner* — James Triggs
(74) *Attorney, Agent, or Firm* — Oliff & Berridge, PLC

(57) ABSTRACT

An apparatus for storing a device for a railway vehicle, comprises a storage case having an opening at a front side, a tray accommodated into the storage case, the tray being movable forward and backward with the device mounted thereon, a lever disposed at an upper side of the tray to extend along a forward and backward direction, the lever being vertically pivotable around a pivot forward relative to a center of the tray in the forward and backward direction, an operation member coupled to a front end portion of the lever and disposed at a front side of the tray, an engagement portion provided at a rear end portion of the lever and protruding downward outside the tray, and a recess provided in the storage case, the engagement portion being fitted into the recess from above.

10 Claims, 8 Drawing Sheets

DEVICE STORAGE APPARATUS FOR RAILWAY VEHICLE

CROSS-REFERENCE TO RELATED APPLICATION

This application claims priority to and the benefit of Japanese Patent Application No. 2010-033312 filed on Feb. 18, 2010, the entire disclosure of which is incorporated herein by reference.

BACKGROUND OF THE INVENTION

1. Field of the Invention

The present invention relates to a device storage apparatus for a railway vehicle.

2. Description of the Related Art

Typically, in a railcar, various devices such as a controller and electric devices are mounted into a storage apparatus and arranged under a floor of a railcar or inside the railcar. During inspection or maintenance, a cover of the storage apparatus is opened, states of the devices in the storage apparatus are checked, and then maintenance of them is carried out if necessary. For example, batteries which are one example of the devices, are mounted to the railcar as a backup electric power supply in the case of electric power failure. To this end, it is necessary to charge the batteries all the time to ensure a situation where the batteries can be used in the case of electric power failure. Therefore, a maintenance operation for checking whether or not an amount and state of battery electrolytes are normal is carried out on a regular basis. Normally, the batteries are mounted under a floor of the railcar. During the maintenance, the batteries are pulled out together with a tray from a storage case.

The railcar tends to shake during driving. Therefore, it is necessary to keep the batteries in a fixed storage position inside the storage case. To this end, in a battery storage apparatus of a conventional example (e.g., see Japanese Unexamined Utility Model Application Publication No. 60-150772), a catcher is provided in a storage case and connected to an operation knob provided above an opening of the storage case via a wire cable, and a latch pin engageable with a engagement protrusion of the catcher is provided at a tray. In accordance with this, the engagement protrusion is locked with the latch pin when the tray is in a storage position to allow the tray to be fixed in the storage position. By pulling the operation knob, the engagement protrusion is unlocked with the latch pin and the tray is pulled out.

To pull out the tray, however, it is necessary to move the tray while operating the operation knob with one hand and holding the tray with the other hand. Such an operation needs a skill because it is performed in a narrow space in a low position at underfloor of the railcar. In addition, the operation for moving the tray with a substantial weight with one hand is unstable. In addition, a lock structure of the tray is such that a pull-operation of the operation knob is transmitted to the catcher via the wire cable to unlock the engagement protrusion of the catcher with respect to the latch pin. Such a lock structure is complex.

SUMMARY OF THE INVENTION

An apparatus for storing a device for a railway vehicle, of the present invention, comprises a storage case having an opening at a front side; a tray accommodated into the storage case, the tray being movable forward and backward with the device mounted thereon; a lever disposed at an upper side of the tray to extend along a forward and backward direction, the lever being vertically pivotable around a pivot forward relative to a center of the tray in the forward and backward direction; an operation member coupled to a front end portion of the lever and disposed at a front side of the tray; an engagement portion provided at a rear end portion of the lever and protruding downward outside the tray; and a recess provided in the storage case, the engagement portion being fitted into the recess from above.

In accordance with this configuration, by pulling out the tray in a forward direction while pushing down the operation member provided at the tray with an operator's hand, the device mounted on the tray can be easily pulled out from the storage case. To be specific, when the operator pushes down the operation member, the rear end portion of the lever moves up according to down movement of the front end portion of the lever, and the engagement portion disengages from the recess, thereby allowing the tray to move in the forward and backward direction. Since the operation member is disposed at the front side of the tray, the operation for disengaging the engagement portion from the recess and the operation for moving the tray can be carried out easily and stably, by pulling out the tray while holding the operation member with the hand and pushing down the operation member. Therefore, with a simple configuration, the operation for inspecting the state, or the like of the device on the tray can be easily carried out.

DETAILED DESCRIPTION OF THE PREFERRED EMBODIMENTS

Hereinafter, an embodiment of the present invention will be described with reference to the drawings. In this embodiment, a battery storage apparatus will be described, but the present invention is applicable to storage apparatuses for various devices as well as batteries. In particular, the present invention is useful in a case where the device is pulled out, inspected and maintained. Hereinafter, it is supposed that the battery storage apparatus is mounted under a floor of a railcar, but may be positioned anywhere else. The stated directions are such that a side of the battery storage apparatus where an opening is formed, i.e., a direction in which the tray is pulled out, is forward.

Figure 1:
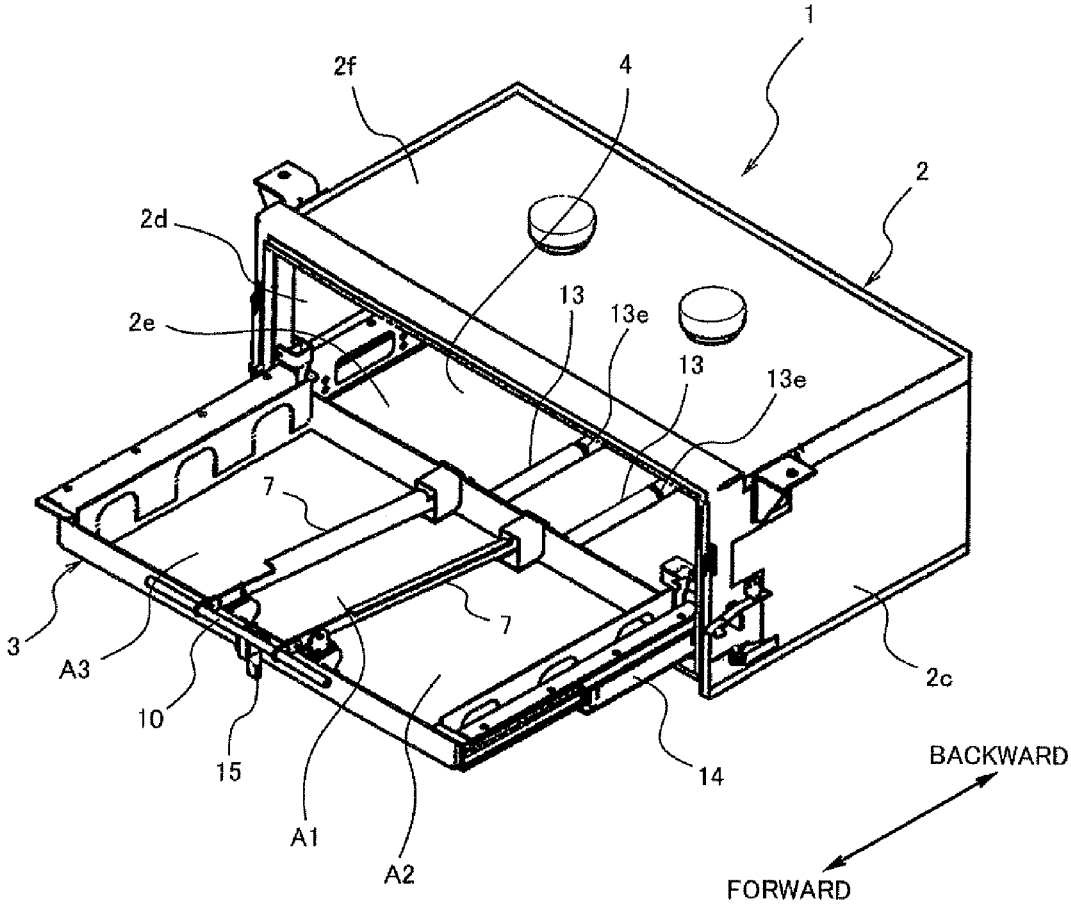
FIG. 1 is a perspective view showing a state where a battery storage apparatus according to an embodiment of the present invention, is pulled out.
Figure 2:
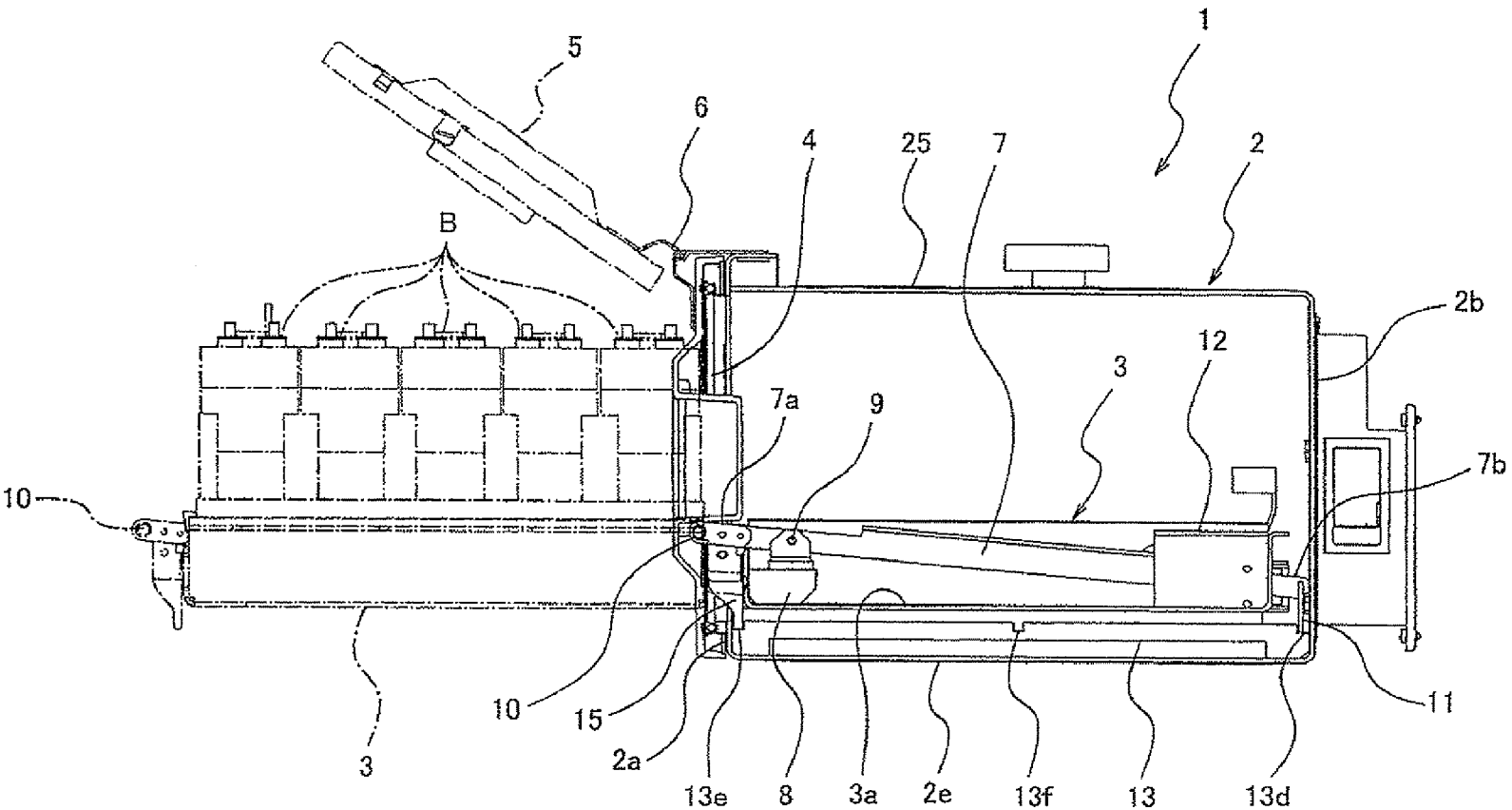
FIG. 2 is a side cross-sectional view (one-dotted line indicates a pulled-out state) in a storage state of the battery storage apparatus of FIG. 1.

FIG. 1 is a perspective view showing a state where a battery storage apparatus 1 according to an embodiment of the present invention, is pulled out. FIG. 2 is a side cross-sectional view (one-dotted line indicates a pulled-out state) in a storage state of the battery storage apparatus 1 of FIG. 1. In FIG. 1, a cover 5 is omitted. As shown in FIGS. 1 and 2, the battery storage apparatus 1 includes a storage case 2, and a tray 3 accommodated into the storage case 2 such that the tray 3 is movable forward and backward and batteries B are mounted on the tray 3. The storage case 2 has a rectangular-prism box shape which is elongated in a lateral direction, having a front wall 2*a*, a rear wall 2*b*, a right side wall 2*c*, a left side wall 2*d*, a bottom wall 2*e* and an upper wall 2*f*. The front wall 2*a* has a rectangular opening 4 which is large in size. Since the opening 4 has a large size, the front wall 2*a* is substantially present only at an edge portion of the opening 4. An upper end portion of the cover 5 for closing the opening 4 is mounted to the front wall 2*a* at an upper edge portion of the opening 4 via a hinge 6 such that the cover 5 is vertically pivotable around the hinge 6 to be opened and closed. The hinge 6 includes a retaining mechanism (not shown) for retaining the cover 5 in an open position up to which the cover 5 is pivoted in an upward direction by about 100 degrees. The storage case 2 is provided with elongate members 13 extending in a forward and backward direction at an upper side of the bottom wall 2*e* and at a lower side of the tray 3 as described later.

Figure 3:
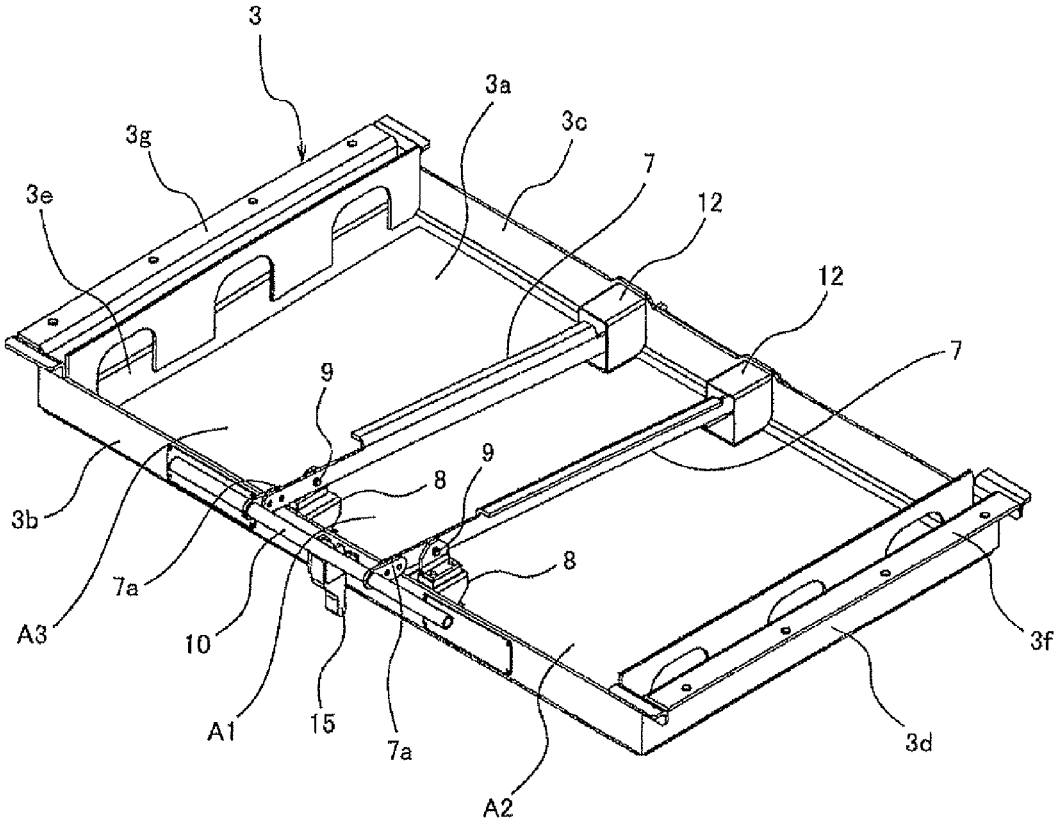
FIG. 3 is a perspective view of a tray of FIG. 1.
Figure 4:
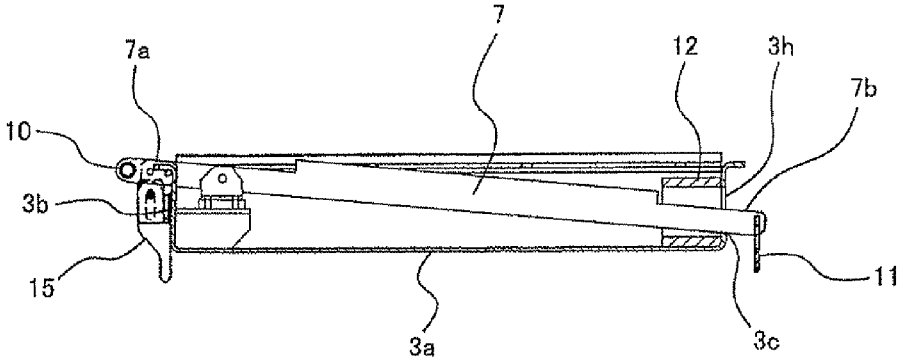
FIG. 4 is a side cross-sectional view of the tray of FIG. 3.

FIG. 3 is a perspective view of the tray 3 of FIG. 1. FIG. 4 is a side cross-sectional view of the tray of FIG. 3. As shown in FIGS. 2 to 4, the tray 3 includes a bottom plate 3*a*, a front plate 3*b*, a rear plate 3*c*, a right side plate 3*d* and a left side plate 3*e*. The height of the front plate 3*b*, the height of the rear plate 3*c*, the height of the right side plate 3*d*, and the height of the left side plate 3*e* are less than a half of the size of the opening 4 and the height of the batteries B. Flange plates 3*f* and 3*g* are provided at both side surfaces 3*d* and 3*e* of the tray 3 to extend outward in a substantially horizontal direction from upper ends thereof, respectively. The tray 3 is supported on the storage case 2 via slide mechanisms 14 (see FIG. 1) attached to both side surfaces thereof such that the tray 3 is movable forward and backward.

The tray 3 is provided with a pair of levers 7 arranged in a center region in a width direction thereof at an upper side of the tray 3 such that the levers 7 extend in the forward and backward direction and are vertically pivotable around pivots forward relative to a center of the tray 3 in the forward and backward direction, respectively. To be specific, each lever 7 is formed by an elongate plate and a part of it is bent in L-shape in cross-section. Support members 8 are welded and fastened to an inner surface of the front plate 3*b* and an inner surface of the bottom plate 3*a* at a front end portion of the tray 3. Each lever 7 is pivotable around a rotational axis which is perpendicular to a longitudinal direction of the lever by a pivot 9 provided at an upper end portion of the corresponding support member 8. The pair of right and left levers 7 are positioned to sandwich a battery region A1 between them. The right lever 7 is positioned to be spaced a battery region A2 apart from the right side plate 3*d* of the tray 3, while the left lever 7 is positioned to be spaced a battery region A3 apart from the left side plate 3*e* of the tray 3.

A front end portion 7*a* of each lever 7 protrudes slightly forward to extend above the front plate 3*b* of the tray 3. A single pipe-shaped operation member 10 is provided integrally with the front end portions 7*a* of the pair of levers 7 so as to extend in a lateral direction along the front plate 3*b* to connect the front end portions 7*a*. A rear end portion 7*b* of each lever 7 is inserted into an insertion hole 3*h* (see FIG. 4) formed at the rear plate 3*c* of the tray 3 and protrudes slightly backward through the insertion hole 3*h*. An engagement portion 11 is welded and fastened to the rear end portion 7*b* of the lever 7 behind the tray 3 to protrude downward. The engagement portion 11 has a plate shape and is fixed to the lever 7 such that its normal line is oriented in the forward and backward direction. A stopper 12 of a tubular shape with a rectangular cross-section is welded and fastened to the rear plate 3*c* of the tray 3 around each insertion hole 3*h*. Since a pivot 9 around which the lever 7 is pivotable is positioned relatively forward, the lever 7 is tilted in a downward direction from the front end portion 7*a* to the rear end portion 7*b* in a state where the operation member 10 is not operated.

Figure 5:
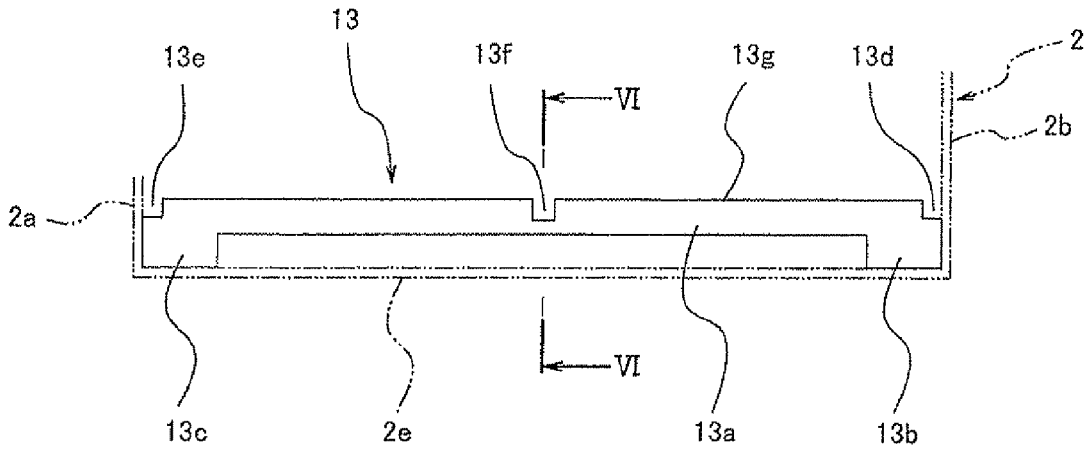
FIG. 5 is a side view of an elongate member of FIG. 2.
Figure 6:
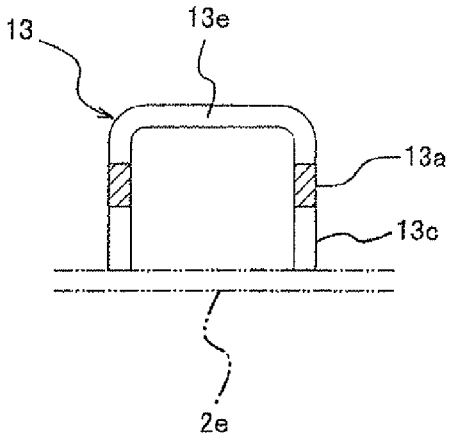
FIG. 6 is a cross-sectional view taken along VI-VI of FIG. 5.

FIG. 5 is a side view of the elongate member 13 of FIG. 2. FIG. 6 is a cross-sectional view taken along VI-VI of FIG. 5. As shown in FIGS. 2, 5, and 6, the elongate member 13 is formed by press-forming of an elongate plate in an inverted-U-shape, when the elongate member 13 is viewed in a longitudinal direction thereof. The elongate member 13 includes an intermediate portion 13*a* extending in the forward and backward direction above the bottom wall 2*c* of the storage case 2, a rear end support portion 13*b* provided at a rear portion of the intermediate portion 13*a*, and welded and fastened to the rear wall 2*b* and the bottom wall 2*e* of the storage case 2, and a front end support portion 13*c* provided at a front portion of the intermediate portion 13*a*, and welded and fastened to the front wall 2*a* and the bottom wall 2*e* of the storage case 2. The elongate member 13 is disposed with a gap with respect to the bottom plate 3*a* of the tray 3 in a storage state. An upper end 13*g* of the elongate member 13 extends in a substantially straight-line shape in the forward and backward direction.

Each elongate member 13 has a plurality of recesses 13*d*, 13*e* and 13*f* which are spaced apart from each other in the forward and backward direction and into which the engagement portion 11 of the lever 7 is fitted thereinto. The first recess 13*d* is formed by cutting a rear end of the elongate member 13 in a downward direction from an upper end of the elongate member 13 and the second recess 13*e* is formed by cutting a front end of the elongate member 13 in a downward direction from the upper end of the elongate member 13. The cut portions are opposite to the front wall 2*a* and the rear wall 2*b* of the storage case 2 and thus have a groove shape extending in the lateral direction. The third recess 13*f* is formed by cutting in a downward direction a center portion in the forward and backward direction, from the upper end of the elongate member 13 and thus has a groove shape extending in the lateral direction.

The first recess 13*d* at a rearmost side is provided in a position to allow the engagement portion 11 to be fitted thereinto from above when the tray 3 is in a storage position (rearmost position) in which the tray 3 is accommodated into the storage case 2. The second recess 13*e* at a foremost side is provided in a position to allow the engagement portion 11 to be fitted thereinto from above when the tray 3 is pulled out from the storage case 2 and is in a storage position (foremost position) in which all of the battery regions A1 to A3 are outside the storage case 2. The third recess 13*f* which is between the first recess 13*d* and the second recess 13*e* is provided in a position to allow the engagement portion 11 to be fitted thereinto from above when the tray 3 is in an intermediate position in a moving range of the tray 3. An auxiliary lock member 15 is provided at the front plate 3*b* of the tray 3 such that the auxiliary lock member 15 is vertically slidable.

When the tray 3 is in a storage position (rearmost position) in which the tray 3 is accommodated into the storage case 2, the auxiliary lock member 15 is disposed at an inner surface side of the front wall 2*a* to inhibit the tray 3 from being pulled out.

Figure 7A:
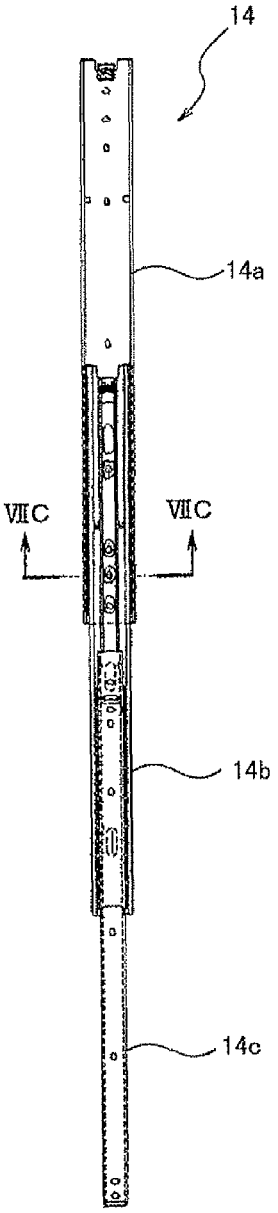
FIG. 7A is a side view of a slide mechanism of FIG. 1.
Figure 7B:
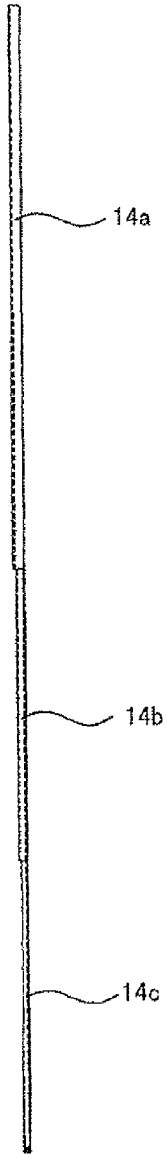
FIG. 7B is a plan view of the slide mechanism of FIG. 7A.
Figure 7C:
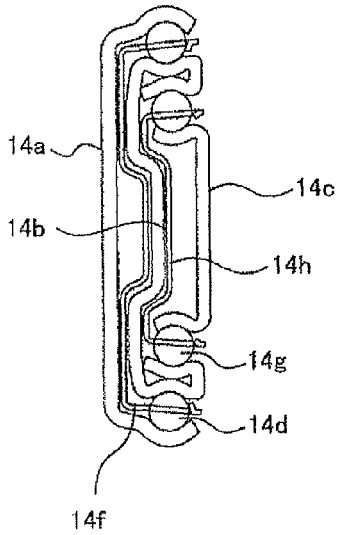
FIG. 7C is a cross-sectional view taken along line VIIC-VIIC of FIG. 7A.

FIG. 7A is a side view of the slide mechanism 14 of FIG. 1, FIG. 7B is a plan view of the slide mechanism 14 of FIG. 7A, and FIG. 7C is a cross-sectional view taken along line VIIC-VIIC of FIG. 7A. As shown in FIG. 1 and FIGS. 7A to 7C, the slide mechanisms 14 serve to slidably move the tray 3 relative to the storage case 2 in the forward and backward direction. Each slide mechanism 14 includes an outer rail 14*a* having a substantially U-shaped cross-section, an intermediate rail 14*b* having a substantially U-shaped cross-section and being slidably mounted into the outer rail 14*a*, and an inner rail 14*c* having a substantially U-shaped cross-section and being slidably mounted into the intermediate rail 14*b*. A ball bearing 14*d* is mounted between the outer rail 14*a* and the intermediate rail 14*b* via a retainer 14*f*. A ball bearing 14*g* is mounted between the intermediate rail 14*b* and the inner rail 14*c* via a retainer 14*h*.

The outer rail 14*a* is attached to an inner surface of the storage case 2, while the inner rail 14*c* is attached to an outer surface of the tray 3. When the rails 14*a*, 14*b* and 14*c* are in a closed state (most contracted state), the rails 14*a*, 14*b* and 14*c* substantially entirely overlap with each other, and the tray 3 is accommodated into the storage case 2. On the other hand, when the rails 14*a*, 14*b* and 14*e* are moved to an open state (most extended state), they slide to deviate from each other and the battery regions A1 to A3 are outside the storage case 2.

Figure 8:
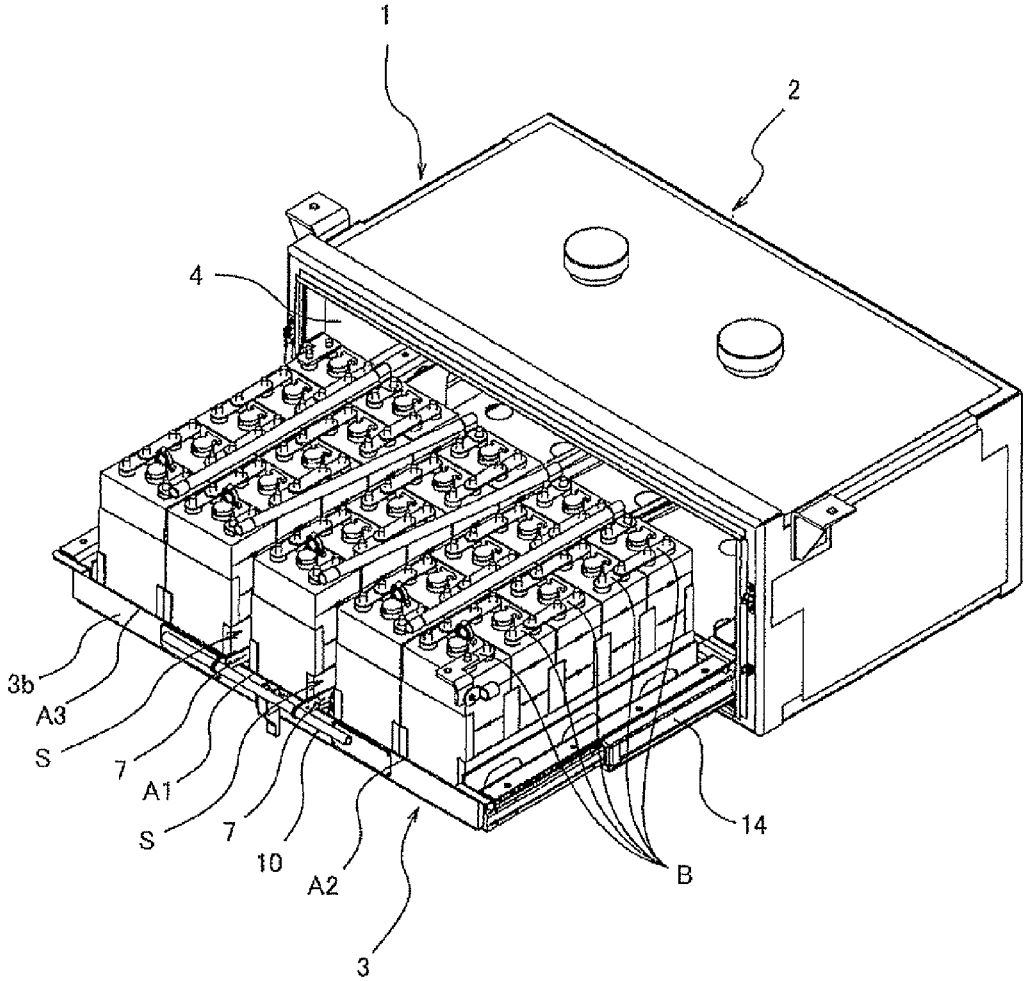
FIG. 8 is a perspective view showing a state where batteries are mounted in the battery storage apparatus of FIG. 1.

FIG. 8 is a perspective view showing a state where the batteries B are mounted in the battery storage apparatus 1 of FIG. 1. As shown in FIG. 8, five rows of batteries B which are longitudinally elongate secondary batteries are mounted onto the tray 3. Containers of the batteries B are transparent or semi-transparent. The battery regions A1 to A3 of the tray 3 are defined in such a manner that plural battery groups each including the batteries B of two rows or less are arranged with a visual space S between them. To be specific, the batteries B of one row are disposed in the battery region A1 at a center, and groups of the batteries B of two rows are disposed in the right and left battery regions A2 and A3 without a substantial clearance. The batteries B in the battery region A1 at the center are disposed with the visual space S extending in the forward and backward direction with respect to each of the groups of the batteries B disposed in right and left battery regions A2 and A3. The above mentioned lever 7 is disposed to extend through the visual space S.

Figure 9:
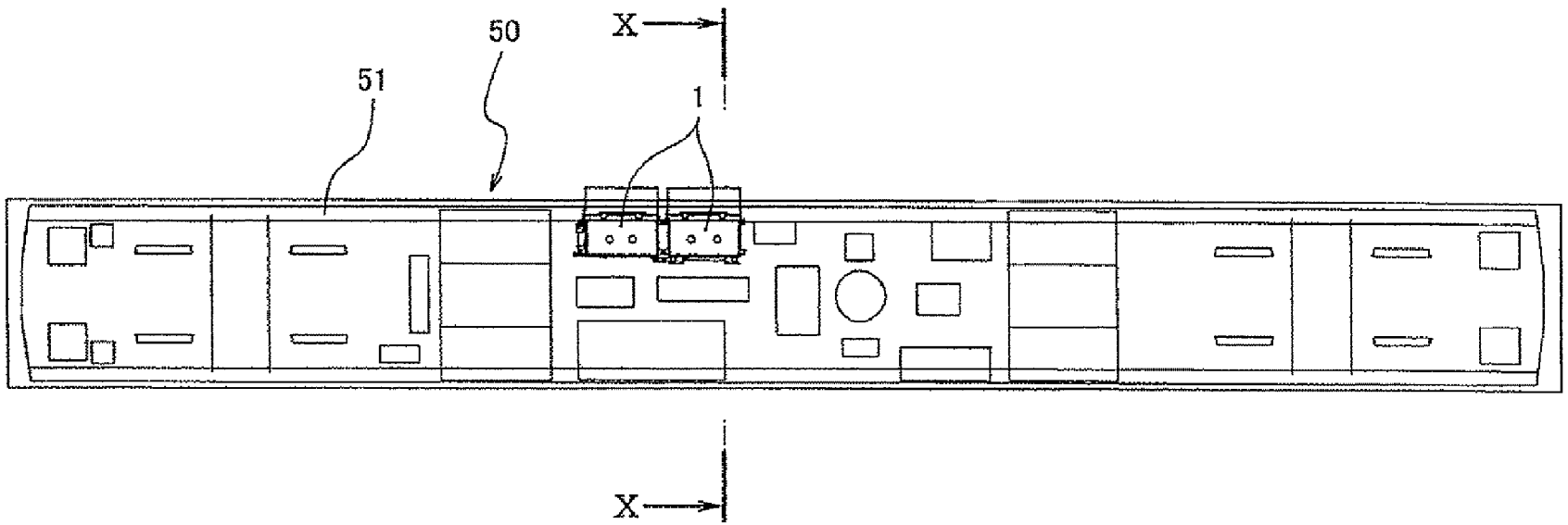
FIG. 9 is a bottom view showing a state where the battery storage apparatus of FIG. 1 is mounted under a floor of a railcar.
Figure 10:
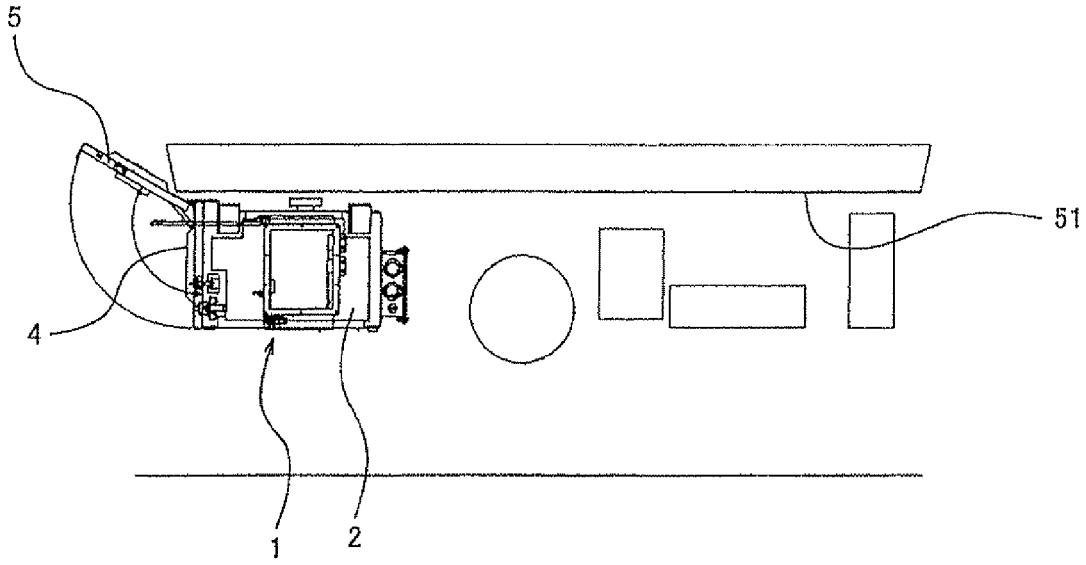
FIG. 10 is a cross-sectional view taken along X-X of FIG. 9.

FIG. 9 is a bottom view showing a state where the battery storage apparatus 1 of FIG. 1 is mounted of a railcar 50. FIG. 10 is a cross-sectional view taken along X-X of FIG. 9. As shown in FIGS. 9 and 10, the battery storage apparatus 1 of FIG. 1 is mounted to a lower surface of a floor 51 of the railcar 50. Typically, the battery storage apparatus 1 is disposed such that the opening 4 of the storage case 2 is oriented in a lateral direction of the railcar 50. An operator carries out a maintenance operation for inspecting the amount, state, etc. of electrolytes of the batteries B accommodated into the battery storage apparatus, periodically.

Next, the maintenance operation carried out by the operator will be described with reference to FIGS. 1, 2, 8 and other Figures. When the tray 3 is in the storage position, the auxiliary lock member 15 is disposed at the inner surface side of the front wall 2*a* of the storage case 2 to prevent the tray 3 from being pulled out, and the engagement portion 11 is fitted into the first recess 13*d* to prevent the tray 3 from shaking. When the maintenance operation is initiated, the operator pivots the cover 5 of the storage case 2 in an upward direction to open the opening 5. In this state, the operator slides the auxiliary lock member 15 in an upward direction to prevent the auxiliary lock member 15 from interfering with the front wall 2*a*. The operator holds the operation member 10 at the front side of the tray 3 with one hand and pushes it down, thereby disengaging the engagement portion 11 from the first recess 13*d*. In this state, the operator pulls out the tray 3 in a forward direction while holding the operation member 10. In this case, the rear end portion 7*b* which is going to move up according to the push-down of the operation member 10 is prevented from further moving up by the stopper 12 in a state where the first engagement portion 11 disengages from the first recess 13*d*.

By pulling out the tray 3, the engagement portion 11 moves forward relative to the first recess 13*d*. At this time point, the operator may continue or stop pushing down the operation member 10. The reason is as follows. Even when the operator stops pushing down the operation member 10 and thereby the engagement portion 11 moves down because of the weight of the lever 7 and the weight of the engagement portion 11, the engagement portion 11 slides on the upper end 13*g* of the elongate member 13 and does not affect the pull-out operation of the tray 3. When the tray 3 is being pulled out in a state where the operator is not pushing down the operation member 10, the engagement portion 11 is automatically fitted into the third recess 13*f* in an intermediate position because of the weight of the lever 7 and the weight of the engagement portion 11, so that the tray 3 is fixed in a state where it is partially pulled out.

The operator inspects the amount, state, etc. of electrolytes of the batteries B of five rows on the tray 3 partially pulled out through the visual spaces S, or the like. In this case, if the operator judges that maintenance is unnecessary for all of the batteries B, the operator pushes down the operation member 10 to disengage the engagement portion 11 from the third recess 13*f*, and pushes the tray 3 back while holding the operation member 10, thereby accommodating the tray 3 into the storage case 2. On the other hand, if the operator judges that maintenance for the batteries B is necessary, the operator pushes down the operation member 10 to disengage the engagement portion 11 from the third recess 13*f*, and in this state, pulls out the tray 3 to the foremost position (pull-out position).

When the operator stops pushing down the operation member 10 in the foremost position, the engagement portion 11 is fitted into the second recess 13*e*, and the tray 3 is fixed stably. In this state, the operator's hands are free. The operator carries out a maintenance operation for refilling electrolytes of the batteries B, etc., easily and safely. When the maintenance operation is accomplished, the operator pushes down the operation member 10 to disengage the engagement portion 11 from the second recess 13*e*, and pushes the tray 3 back to accommodate the tray 3 into the storage case 2. When the tray 3 is moved back to the storage position, the engagement portion 11 is automatically fitted and fixed into the first recess 13*d* by releasing the operation member 10. By closing the opening 4 with the cover 5, the operation is finished.

In accordance with the configuration described above, by pulling out the tray 3 in a forward direction while pushing down the operation member 10 provided at the tray 3 with the operator's hand, the batteries B mounted on the tray 3 are easily pulled out from the storage case 2. To be specific, when the operator pushes down the operation member 10, the rear end portion 7*b* of the lever 7 moves up according to down movement of the front end portion 7*a* of the lever 7, and the engagement portion 11 disengages from the recess 13*d*, 13*e* or 13*f*, thereby allowing the tray 3 to move in the forward and backward direction. Since the operation member 10 is disposed at the front side of the tray 3, the tray 3 can be pulled out or pushed back while holding the operation member 10 with the hand. Therefore, the operation for disengaging the engagement portion 11 from the recess 13*d*, 13*e*, or 13*f* and the operation for moving the tray 3 can be carried out easily and stably. Therefore, with a simple configuration, the operation for inspecting the amount, state, or the like of the electrolytes of the batteries B on the tray 3 can be easily carried out.

Since the tray 3 is fixed by engagement between the engagement 11 and the recesses 13*d*, 13*f* and 13*e* when the tray 3 is entirely accommodated into the storage case 2, when the tray 3 is partially pulled out, and when the tray 3 is entirely pulled out, the batteries B can be inspected in a state where the tray 3 is partially pulled out and retained stably, and the tray 3 can be accommodated into the storage case 2 without maintenance, if it is judged that the maintenance is unnecessary. This makes it possible to accomplish the inspection operation without a need to entirely pull out the tray 3 on which the batteries B with a heavy weight are mounted. Thus, the operation for inspecting the batteries B can be carried out efficiently.

When the operator releases the operation member 10 and the engagement portion 11 moves down because of its weight during the movement of the tray 3, the engagement portion 11 slides on the upper end 13*g* of the elongate member 13. Therefore, a burden on the operator for operating the operation member 10 can be lessened. Furthermore, since the plurality of levers 7 are provided at the center region in the width direction to sandwich the battery region A1, and are coupled to the single operation member 10, the tray 3 can be positioned more stably while maintaining easiness of the operation.

Since the elongate member 13 provided with the recesses 13*d*, 13*e* and 13*f* is fixed to connect the front wall 2*a* of the storage case 2 to the rear wall 2*b* of the storage case 2, the storage case 2 can be reinforced. Since the stopper 12 determining a pivot movement limit of the rear end portion 7*b* of the lever 7 is fastened to the tray 3 around each insertion hole 3*h*, it can reinforce a region around each insertion hole 3*h*.

The number of the recesses 13*d*, 13*e*, and 13*f* is not limited to three but is preferably plural. The third recess 13*f* in the intermediate position need not be a center between the first recess 13*d* and the second recess 13*e*, but may be anywhere else so long as the tray 3 can be partially pulled out and the batteries B can be inspected. A plurality of recesses may be provided in the intermediate position, instead of a single recess. The number of levers 7 is not limited to two but may be one or three or more. When three or more levers 7 are provided, it is desirable that these levers 7 operate in association with the common single operation member 10. The lever 7 is not limited to a plate, but may be a rod. The tray 3 has a rectangle shape which is elongated in a lateral direction and is short in the forward and backward direction, but may have a rectangle shape which is elongate in the forward and backward direction.

What is claimed is:

1. An apparatus for storing a device for a railway vehicle comprising:

a storage case having an opening at a front side;

a tray accommodated into the storage case, the tray being movable forward and backward with the device mounted thereon;

a lever disposed at the tray to extend along a forward and backward direction, the lever being vertically pivotable around a pivot located forward relative to a center of the tray in the forward and backward direction;

an operation member coupled to a front end portion of the lever and disposed at a front side of the tray;

an engagement portion provided at a rear end portion of the lever and protruding downward outside the tray; and a recess provided in the storage case, the engagement portion being fitted into the recess from above.

2. The apparatus for storing the device for the railway vehicle according to claim 1, wherein the recess is positioned such that the engagement portion is fitted into the recess from above at least in a state where the tray is in a storage position where the tray is accommodated into the storage case.

3. The apparatus for storing the device for the railway vehicle according to claim 1, wherein the recess is positioned such that the engagement portion is fitted into the recess from above at least in a state where the tray is in an intermediate position in a moving range of the tray.

4. The apparatus for storing the device for the railway vehicle according to claim 1, wherein the recess is positioned such that the engagement portion is fitted into the recess from above at least in a state where the tray is in a pull-out position where the tray is pulled out through the opening and an entire of a device region of the tray is outside the storage case.

5. The apparatus for storing the device for the railway vehicle according to claim 1, wherein the storage case includes an elongate member extending in the forward and backward direction at an upper side of a bottom wall of the storage case and at a lower side of the tray and having an upper end extending in a substantially straight-line shape in the forward and backward direction; and the recess extends in a downward direction from the upper end of the elongate member.

6. The apparatus for storing the device for the railway vehicle according to claim 5, wherein the storage case includes a rear wall, a front wall having the opening; and a rear end of the elongate member is fixed to the rear wall and a front end of the elongate member is fixed to the front wall.

7. The apparatus for storing the device for the railway vehicle according to claim 1, further comprising:

a stopper provided at the tray to inhibit the lever from moving in an upward direction in a state where a rear end portion of the lever is pivoted in the upward direction and the engagement portion disengages from the recess.

8. The apparatus for storing the device for the railway vehicle according to claim 7, wherein the tray includes a rear plate having an insertion hole into which the rear end portion of the lever is inserted; and the stopper is fixed to the rear plate around the insertion hole.

9. The apparatus for storing the device for the railway vehicle according to claim 1, wherein the device is a battery; and the lever includes a plurality of levers to sandwich at least one battery region between them, and front end portions of the plurality of levers are coupled to one operation member.

10. The apparatus for storing the device for the railway vehicle according to claim 1, wherein the device is a battery;

the tray has battery regions in which batteries of plural rows are mounted;

the battery regions are defined in such a manner that plural battery groups each including the batteries of two rows or less are arranged with a visual space between them; and the lever is disposed in the visual space.

* * * * *